US008903296B2

(12) United States Patent
Shimokawa et al.

(10) Patent No.: US 8,903,296 B2
(45) Date of Patent: Dec. 2, 2014

(54) FIXING DEVICE AND IMAGE FORMING APPARATUS INCORPORATING SAME

(75) Inventors: Toshihiko Shimokawa, Kanagawa (JP); Yuji Arai, Kanagawa (JP); Hiromasa Takagi, Tokyo (JP); Yoshiki Yamaguchi, Kanagawa (JP); Arinobu Yoshiura, Kanagawa (JP); Tetsuo Tokuda, Kanagawa (JP); Yutaka Ikebuchi, Kanagawa (JP); Kenji Ishii, Kanagawa (JP); Naoki Iwaya, Tokyo (JP); Takahiro Imada, Kanagawa (JP); Hiroshi Yoshinaga, Chiba (JP); Takuya Seshita, Kanagawa (JP); Hajime Gotoh, Kanagawa (JP); Ippei Fujimoto, Kanagawa (JP); Masaaki Yoshikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 149 days.

(21) Appl. No.: 13/326,847

(22) Filed: Dec. 15, 2011

(65) Prior Publication Data

US 2012/0177420 A1 Jul. 12, 2012

(30) Foreign Application Priority Data

Jan. 11, 2011 (JP) ..... 2011-003336

(51) Int. Cl.
*G03G 15/20* (2006.01)

(52) U.S. Cl.
CPC .... *G03G 15/2053* (2013.01); *G03G 2215/2035* (2013.01); *G03G 15/2017* (2013.01); *G03G 15/2064* (2013.01)
USPC ..... 399/334; 399/122; 399/329

(58) Field of Classification Search
CPC ..... G03G 15/2017; G03G 15/2042; G03G 15/2053; G03G 15/2082; G03G 2215/2035
USPC ..... 399/122, 329
See application file for complete search history.

(56) References Cited

U.S. PATENT DOCUMENTS 5,722,026 A * 2/1998 Goto et al. ..... 399/333
7,885,569 B2 2/2011 Kishi et al.

(Continued)

FOREIGN PATENT DOCUMENTS

JP 2009-3410 1/2009

OTHER PUBLICATIONS

U.S. Appl. No. 13/217,488, filed Aug. 25, 2011, Yutaka Ikebuchi, et al.

(Continued)

*Primary Examiner* — Benjamin Schmitt
(74) *Attorney, Agent, or Firm* — Oblon, Spivak, McClelland, Maier & Neustadt, L.L.P.

(57) ABSTRACT

A fixing device includes a thermal conductor disposed inside a flexible endless fixing belt formed into a loop and configured to conduct heat from a heater to the fixing belt. The thermal conductor includes a center heating portion heated by the heater and disposed at a center of the thermal conductor in a longitudinal direction thereof orthogonal to a conveyance direction of a recording medium conveyed to the fixing belt and lateral end non-heating portions disposed at lateral ends of the thermal conductor in the longitudinal direction thereof and contiguous to the center heating portion. The center heating portion having a first diameter conducts heat from the heater to the fixing belt. The lateral end non-heating portions having a second diameter smaller than the first diameter of the center heating portion minimize conduction of heat from the heater to the fixing belt.

8 Claims, 7 Drawing Sheets

(56) References Cited

U.S. PATENT DOCUMENTS

| | | | | |
|---|---|---|---|---|
| 7,957,663 | B2 | 6/2011 | Kishi et al. | |
| 8,064,798 | B2 | 11/2011 | Shinshi et al. | |
| 2004/0223795 | A1* | 11/2004 | Ono et al. | 399/329 |
| 2006/0245800 | A1* | 11/2006 | Fujino | 399/329 |
| 2008/0061054 | A1* | 3/2008 | Shirakata et al. | 219/619 |
| 2008/0175633 | A1* | 7/2008 | Shinshi | 399/329 |
| 2010/0092220 | A1* | 4/2010 | Hasegawa et al. | 399/328 |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064451 | A1 | 3/2011 | Yamaguchi et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085832 | A1 | 4/2011 | Hasegawa et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0274453 | A1 | 11/2011 | Shimokawa et al. | |
| 2011/0286758 | A1 | 11/2011 | Yoshinaga | |

OTHER PUBLICATIONS

U.S. Appl. No. 13/293,794, filed Nov. 10, 2011, Masuaki Yoshikawa, et al.
U.S. Appl. No. 13/293,561, filed Nov. 10, 2011, Tetsuo Tokuda, et al.
U.S. Appl. No. 13/286,796, filed Nov. 1, 2011, Ippei Fujimoto, et al.

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2011-003336, filed on Jan. 11, 2011 in the Japanese Patent Office, the entire disclosure of which is hereby incorporated by reference herein.

FIELD OF THE INVENTION

Exemplary aspects of the present invention relate to a fixing device and an image forming apparatus, and more particularly, to a fixing device for fixing a toner image on a recording medium and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a flexible endless fixing belt formed into a loop, a substantially tubular thermal conductor disposed inside the loop formed by the fixing belt, and a pressing roller pressed against the thermal conductor via the fixing belt to form a fixing nip between the pressing roller and the fixing belt. A heater disposed inside the thermal conductor heats the thermal conductor which in turn heats the fixing belt as the fixing belt rotates and slides over the thermal conductor. As a recording medium bearing a toner image passes through the fixing nip, the fixing belt heated by the heater via the thermal conductor and the pressing roller together apply heat and pressure to the recording medium, thus melting and fixing the toner image on the recording medium.

Conventionally, a lubricant, such as silicone oil or fluorine grease, is applied between the fixing belt and the thermal conductor to minimize friction therebetween. As the fixing belt slides over the thermal conductor, the lubricant is circulated through a circulation path formed between the fixing belt and the thermal conductor, decreasing friction between the fixing belt and the thermal conductor and therefore minimizing wear of the fixing belt and the thermal conductor.

Although effective for its intended purpose, the above-described configuration has a drawback in that the thermal conductor may overheat where a gap of any significant width appears between the fixing belt and the thermal conductor, because the gap disrupts heat conduction from the thermal conductor to the fixing belt. As a result, the temperature of the thermal conductor may exceed an upper temperature limit of the lubricant applied between the fixing belt and the thermal conductor beyond which the lubricant breaks down and no longer functions.

To address this problem, a smaller gap may be provided between the fixing belt and the thermal conductor. However, such smaller gap may raise another problem of increasing the contact area in which the thermal conductor contacts the fixing belt, which increases friction between the thermal conductor and the fixing belt sliding over the thermal conductor. Consequently, a greater torque may be required to rotate the fixing belt, with consequent excessive wear on not only the fixing belt but also a drive unit that rotates the fixing belt.

SUMMARY OF THE INVENTION

This specification describes below an improved fixing device. In one exemplary embodiment of the present invention, the fixing device includes a flexible endless fixing belt formed into a loop; a pressing rotary body pressed against an outer circumferential surface of the fixing belt to form a fixing nip therebetween through which a recording medium bearing a toner image is conveyed; a substantially tubular thermal conductor disposed opposite an inner circumferential surface of the fixing belt; and a heater disposed inside the thermal conductor to heat the fixing belt via the thermal conductor. The thermal conductor includes a center heating portion heated by the heater and disposed at a center of the thermal conductor in a longitudinal direction thereof orthogonal to a conveyance direction of the recording medium and lateral end non-heating portions disposed at lateral ends of the thermal conductor in the longitudinal direction thereof and continuous with and contiguous to the center heating portion. The center heating portion having a first diameter conducts heat from the heater to the fixing belt. The lateral end non-heating portions having a second diameter smaller than the first diameter of the center heating portion minimize conduction of heat from the heater to the fixing belt.

This specification further describes below an improved fixing device. In one exemplary embodiment of the present invention, the fixing device includes a flexible endless fixing belt formed into a loop; a pressing rotary body pressed against an outer circumferential surface of the fixing belt to form a fixing nip therebetween through which a recording medium bearing a toner image is conveyed; a thermal conductor disposed opposite an inner circumferential surface of the fixing belt; and a heater disposed inside the thermal conductor to heat the fixing belt via the thermal conductor. The thermal conductor includes a center heating portion heated by the heater and disposed at a center of the thermal conductor in a longitudinal direction thereof orthogonal to a conveyance direction of the recording medium and lateral end non-heating portions disposed at lateral ends of the thermal conductor in the longitudinal direction thereof, continuous with and contiguous to the center heating portion. A contact area between each of the lateral end non-heating portions and the fixing belt is smaller than a contact area between the center heating portion and the fixing belt.

This specification further describes below an improved fixing device. In one exemplary embodiment of the present invention, the fixing device includes a flexible endless fixing belt formed into a loop and a pressing rotary body pressed against an outer circumferential surface of the fixing belt to form a fixing nip therebetween through which a recording medium bearing a toner image is conveyed. The pressing rotary body has a length in an axial direction of the fixing belt that is substantially equivalent to a length of the fixing belt. The fixing device further includes a thermal conductor disposed opposite an inner circumferential surface of the fixing belt and a heater disposed inside the thermal conductor to heat the fixing belt via the thermal conductor. The thermal conductor has a length in the axial direction of the fixing belt that is shorter than the length of the pressing rotary body.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
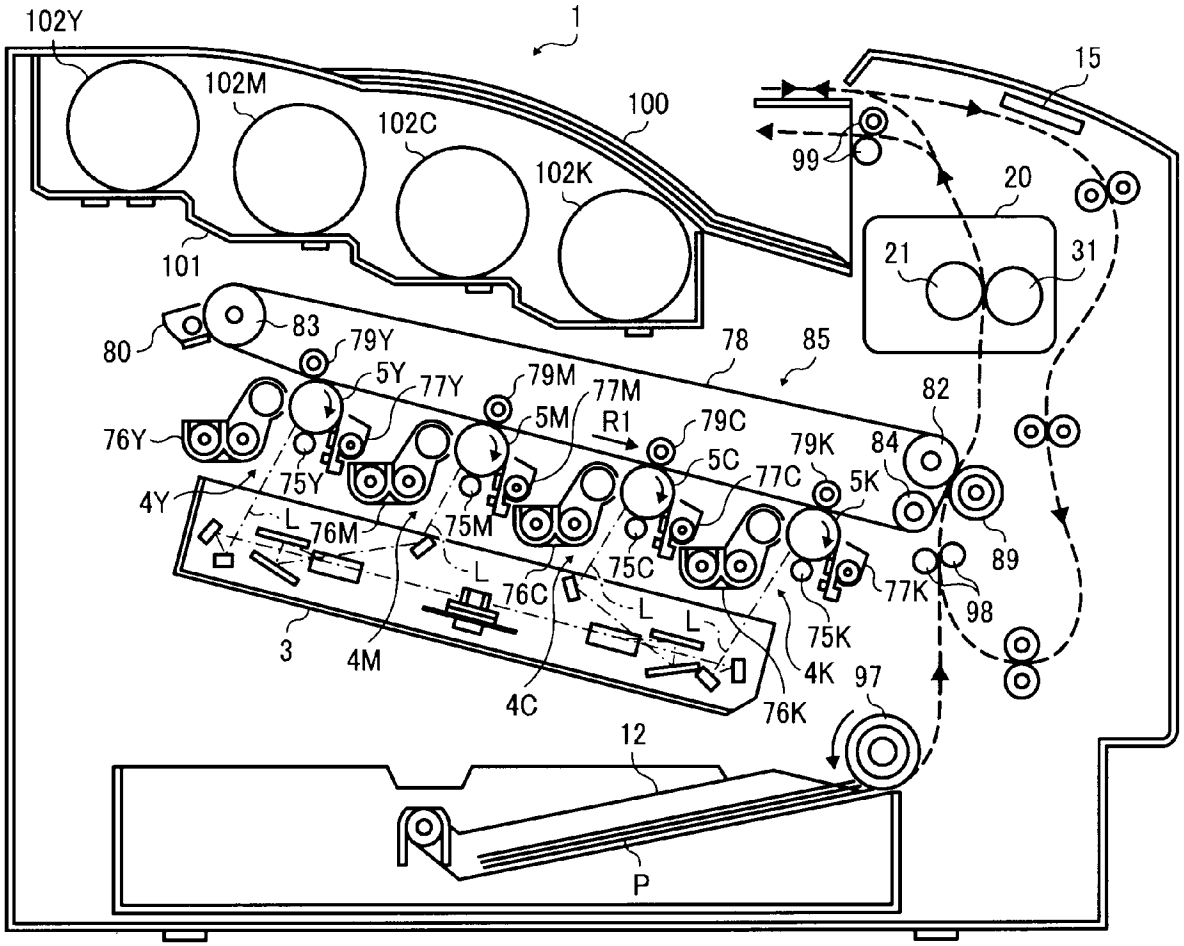
FIG. 1 is a schematic sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to a first embodiment of the present invention is explained.

FIG. 1 is a schematic sectional view of the image forming apparatus 1.

As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium. As illustrated in FIG. 1, the image forming apparatus 1 includes image forming devices 4Y, 4M, 4C, and 4K disposed in a center portion of the image forming apparatus 1; a toner bottle holder 101 disposed above the image forming devices 4Y, 4M, 4C, and 4K in an upper portion of the image forming apparatus 1; an exposure device 3 disposed below the image forming devices 4Y, 4M, 4C, and 4K; a paper tray 12 disposed below the exposure device 3 in a lower portion of the image forming apparatus 1; an intermediate transfer unit 85 disposed above the image forming devices 4Y, 4M, 4C, and 4K and below the toner bottle holder 101; a second transfer roller 89 disposed opposite the intermediate transfer unit 85; a feed roller 97 and a registration roller pair 98 disposed between the paper tray 12 and the second transfer roller 89 in a conveyance direction of a recording medium P; a fixing device 20 disposed above the second transfer roller 89; an output roller pair 99 disposed above the fixing device 20; an output tray 100 disposed downstream from the output roller pair 99 in the conveyance direction of the recording medium P on top of the image forming apparatus 1; and a controller 15 disposed in the upper portion of the image forming apparatus 1.

The toner bottle holder 101 includes four toner bottles 102Y, 102M, 102C, and 102K that contain yellow, magenta, cyan, and black toners, respectively. They are detachably attached to the toner bottle holder 101, thus replaceable with new ones, respectively.

The intermediate transfer unit 85, disposed below the toner bottle holder 101, includes an intermediate transfer belt 78 formed into a loop; four first transfer bias rollers 79Y, 79M, 79C, and 79K, a second transfer backup roller 82, a cleaning backup roller 83, and a tension roller 84 disposed inside the loop formed by the intermediate transfer belt 78; and an intermediate transfer cleaner 80 disposed outside the loop formed by the intermediate transfer belt 78. Specifically, the intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a rotation direction R1.

The image forming devices 4Y, 4M, 4C, and 4K, arranged opposite the intermediate transfer belt 78, form yellow, magenta, cyan, and black toner images, respectively. The image forming devices 4Y, 4M, 4C, and 4K include photoconductive drums 5Y, 5M, 5C, and 5K which are surrounded by chargers 75Y, 75M, 75C, and 75K, development devices 76Y, 76M, 76C, and 76K, cleaners 77Y, 77M, 77C, and 77K, and dischargers, respectively. Image forming processes including a charging process, an exposure process, a development process, a primary transfer process, and a cleaning process are performed on the photoconductive drums 5Y, 5M, 5C, and 5K to form yellow, magenta, cyan, and black toner images thereon, respectively, as a driving motor drives and rotates the photoconductive drums 5Y, 5M, 5C, and 5K clockwise in FIG. 1.

Specifically, in the charging process, the chargers 75Y, 75M, 75C, and 75K uniformly charge an outer circumferential surface of the photoconductive drums 5Y, 5M, 5C, and 5K at charging positions where the chargers 75Y, 75M, 75C, and 75K are disposed opposite the photoconductive drums 5Y, 5M, 5C, and 5K, respectively.

In the exposure process, the exposure device 3 emits laser beams L onto the charged outer circumferential surface of the respective photoconductive drums 5Y, 5M, 5C, and 5K according to image data sent from a client computer, for example. In other words, the laser beams L emitted by the exposure device 3 scan and expose the charged outer circumferential surface of the photoconductive drums 5Y, 5M, 5C, and 5K at irradiation positions where the exposure device 3 is disposed opposite the photoconductive drums 5Y, 5M, 5C, and 5K to irradiate the charged outer circumferential surface of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the outer circumferential surface of the photoconductive drums 5Y, 5M, 5C, and 5K visible as yellow, magenta, cyan, and black toner images at development positions where the development devices 76Y, 76M, 76C, and 76K are disposed opposite the photoconductive drums 5Y, 5M, 5C, and 5K, respectively. Thus, the photoconductive drums 5Y, 5M, 5C, and 5K serve as image carriers that carry the electrostatic latent images and the resultant toner images, respectively.

In the primary transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions where the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions where the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions where the dischargers are disposed opposite the photoconductive drums 5Y, 5M, 5C, and 5K, respectively, thus completing a single sequence of image forming processes performed on the photoconductive drums 5Y, 5M, 5C, and 5K.

The following describes the transfer processes, that is, the primary transfer process described above and a secondary transfer process, performed on the intermediate transfer belt 78.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite a polarity of toner forming the yellow, magenta, cyan, and black toner images on the photoconductive drums 5Y, 5M, 5C, and 5K, respectively. Accordingly, in the primary transfer process, the yellow, magenta, cyan, and black toner images formed on the photoconductive drums 5Y, 5M, 5C, and 5K, respectively, are primarily transferred and superimposed onto the intermediate transfer belt 78 rotating in the rotation direction R1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The second transfer roller 89 is pressed against the second transfer backup roller 82 via the intermediate transfer belt 78 in such a manner that the second transfer roller 89 and the second transfer backup roller 82 sandwich the intermediate transfer belt 78 to form a second transfer nip between the second transfer roller 89 and the intermediate transfer belt 78. At the second transfer nip, the second transfer roller 89 secondarily transfers the color toner image formed on the intermediate transfer belt 78 onto a recording medium P conveyed from the paper tray 12 through the feed roller 97 and the registration roller pair 98 in the secondary transfer process. Thus, the desired color toner image is formed on the recording medium P. After the transfer of the color toner image, residual toner, which has not been transferred onto the recording medium P, remains on the intermediate transfer belt 78.

Thereafter, the intermediate transfer cleaner 80 collects the residual toner from the intermediate transfer belt 78 at a cleaning position where the intermediate transfer cleaner 80 is disposed opposite the cleaning backup roller 83 via the intermediate transfer belt 78, thus completing a single sequence of transfer processes performed on the intermediate transfer belt 78.

The recording medium P is supplied to the second transfer nip from the paper tray 12 which loads a plurality of recording media P (e.g., sheets). Specifically, the feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to the second transfer nip formed between the second transfer roller 89 and the intermediate transfer belt 78, as the color toner image formed on the intermediate transfer belt 78 reaches the second transfer nip.

After the secondary transfer process described above, the recording medium P bearing the color toner image is conveyed to the fixing device 20 that includes a fixing belt 21 and a pressing roller 31. As the recording medium P bearing the color toner image passes between the fixing belt 21 and the pressing roller 31, they apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the output tray 100. Thus, the recording media P discharged by the output roller pair 99 are stacked on the output tray 100 successively to complete a single sequence of image forming processes performed by the image forming apparatus 1.

Figure 2:
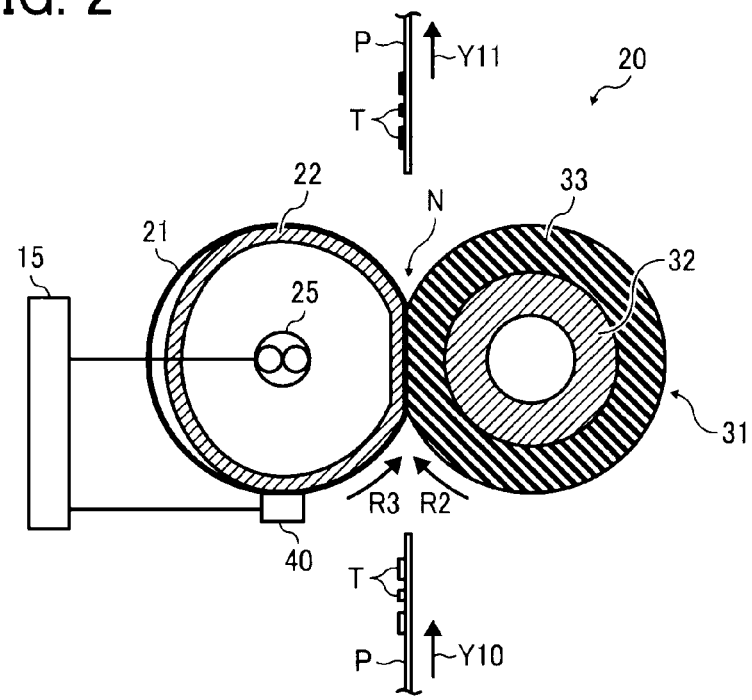
FIG. 2 is a vertical sectional view of a fixing device installed in the image forming apparatus shown in FIG. 1 at a center of the fixing device in a longitudinal direction thereof.
Figure 3:
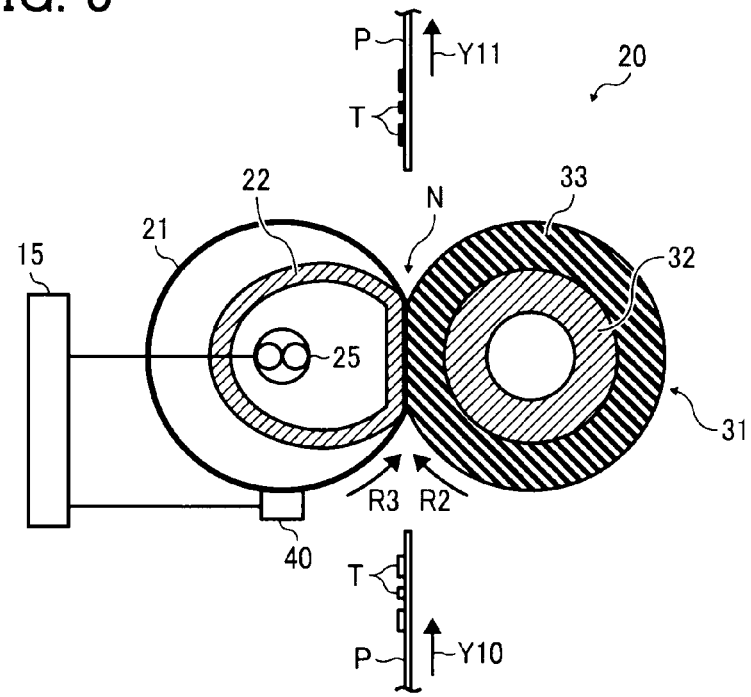
FIG. 3 is a vertical sectional view of the fixing device shown in FIG. 2 at one lateral end of the fixing device in the longitudinal direction thereof.
Figure 4:
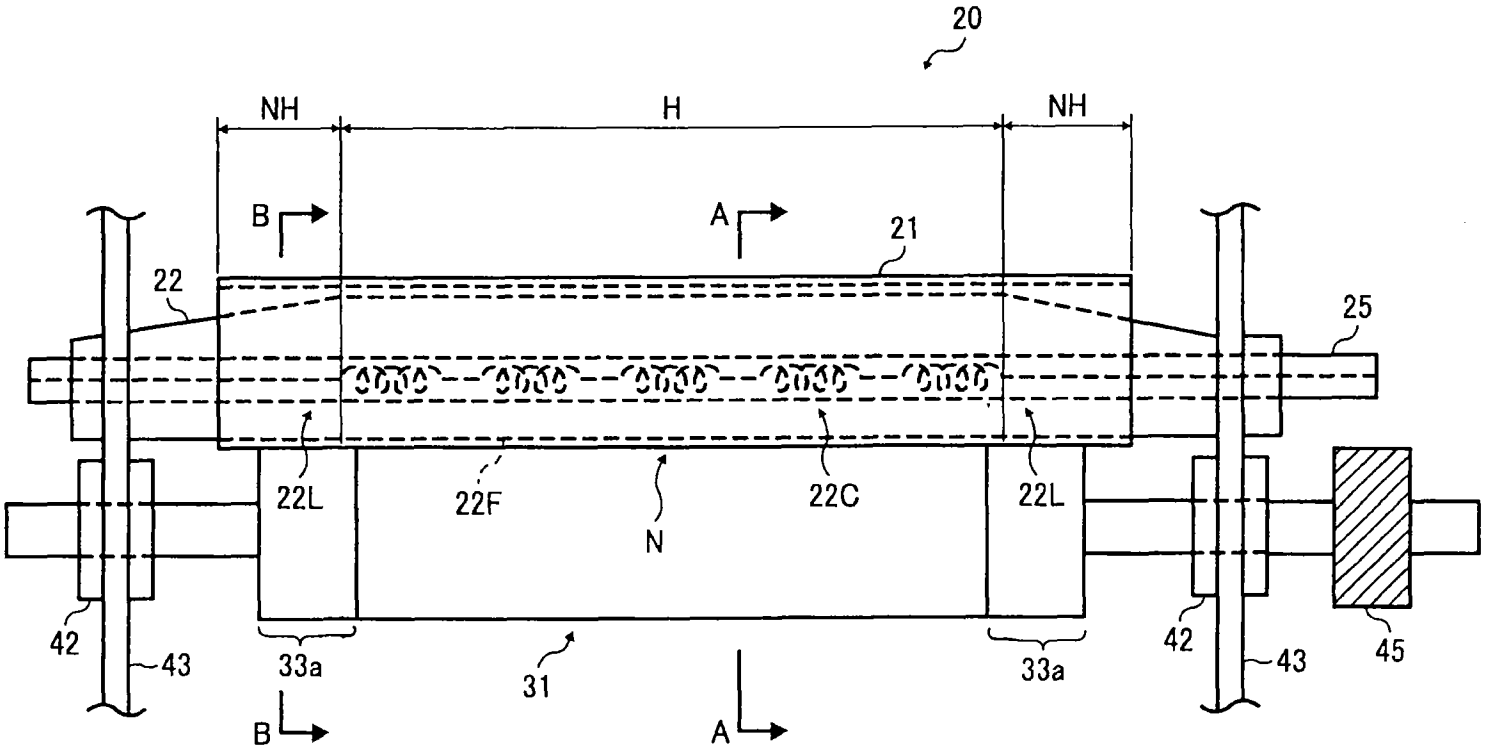
FIG. 4 is a top view of the fixing device shown in FIG. 3.

Referring to FIGS. 2 to 4, the following describes the structure and operation of the fixing device 20 installed in the image forming apparatus 1 described above.

FIG. 2 is a vertical sectional view of the fixing device 20 at a center portion thereof in a longitudinal direction, that is, an axial direction, of the fixing belt 21. FIG. 3 is a vertical sectional view of the fixing device 20 at one of lateral end portions thereof in the axial direction of the fixing belt 21. It is to be noted that the fixing belt 21 heats the recording medium P at the center portion of the fixing device 20 shown in FIG. 2. Contrarily, the fixing belt 21 does not heat the recording medium P at the lateral end portions of the fixing device 20 shown in FIG. 3. The center portion and the lateral end portions of the fixing device 20 are hereinafter referred to as a heating region H and non-heating regions NH, respectively. FIG. 4 is a top view of the fixing device 20. Specifically, FIG. 2 is a sectional view of the fixing device 20 taken along line A-A of FIG. 4. FIG. 3 is a sectional view of the fixing device 20 taken along line B-B of FIG. 4.

As illustrated in FIG. 2, the fixing device 20 (e.g., a fuser unit) includes the pressing roller 31 serving as a pressing rotary body that is rotated by a driver (e.g., a motor) in a rotation direction R2; the fixing belt 21 formed into a loop and serving as a fixing rotary body that is rotated in a rotation direction R3 counter to the rotation direction R2 of the pressing roller 31 by friction between the pressing roller 31 and the fixing belt 21; a substantially tubular thermal conductor 22 disposed inside the loop formed by the fixing belt 21 and disposed opposite the pressing roller 31 via the fixing belt 21; a heater 25 disposed inside a substantial loop formed by the thermal conductor 22; and a temperature sensor 40 disposed outside the loop formed by the fixing belt 21 and serving as a temperature detector that detects a temperature of the fixing belt 21.

As the heater 25 heats the thermal conductor 22, the thermal conductor 22 heats the fixing belt 21. The pressing roller 31 rotatable in the rotation direction R2 is disposed opposite an outer circumferential surface of the fixing belt 21 and is pressed against the fixing belt 21 to form a fixing nip N therebetween through which a recording medium P bearing a toner image T passes. As the recording medium P conveyed in a direction Y 10 passes through the fixing nip N, the fixing belt 21 heated by the heater 25 via the thermal conductor 22 and the pressing roller 31 apply heat and pressure to the recording medium P to fix the toner image T on the recording medium P.

Referring to FIG. 2, a description is now given of the fixing belt 21.

The fixing belt 21 is a flexible, thin endless belt that rotates counterclockwise in FIG. 2 in the rotation direction R3. For example, the fixing belt 21 is constructed of a base layer, an elastic layer disposed on the base layer, and a release layer disposed on the elastic layer. The fixing belt 21 has a thickness not greater than a predetermined thickness, e.g., not greater than about 1 mm.

The base layer of the fixing belt 21, having a thickness in a range of from about 20 micrometers to about 70 micrometers, is made of a metal material such as nickel and stainless steel and/or a resin material such as polyimide.

The elastic layer of the fixing belt 21, having a thickness in a range of from about 100 micrometers to about 300 micrometers, is made of a rubber material such as silicone rubber, silicone rubber foam, and fluorocarbon rubber. The elastic layer eliminates or reduces slight surface asperities of the fixing belt 21 at the fixing nip N formed between the fixing belt 21 and the pressing roller 31. Accordingly, heat is uniformly conducted from the fixing belt 21 to a toner image Ton a recording medium P, minimizing formation of a rough image such as an orange peel image.

The release layer of the fixing belt 21, having a thickness in a range of from about 10 micrometers to about 50 micrometers, is made of tetrafluoroethylene perfluoroalkylvinylether copolymer (PFA), polytetrafluoroethylene (PTFE), polyimide, polyetherimide, and/or polyether sulfide (PES). The release layer releases or separates the toner image T on the recording medium P from the fixing belt 21.

The fixing belt 21 has a loop diameter in a range of from about 15 mm to about 120 mm. According to this exemplary embodiment, the fixing belt 21 has a loop diameter of about 30 mm.

The heater 25 and the thermal conductor 22 are fixedly disposed inside the loop formed by the fixing belt 21 in such a manner that they face an inner circumferential surface of the fixing belt 21. The fixing belt 21 is pressed by the thermal conductor 22 against the pressing roller 31 to form the fixing nip N between the fixing belt 21 and the pressing roller 31.

Referring to FIGS. 2 to 4, a description is now given of the thermal conductor 22.

The thermal conductor 22, which is fixedly disposed inside the fixing belt 21 and disposed opposite the inner circumferential surface of the fixing belt 21, presses against the pressing roller 31 via the fixing belt 21 to form the fixing nip N between the fixing belt 21 and the pressing roller 31. As shown in FIG. 4, lateral ends of the thermal conductor 22 in a longitudinal direction thereof parallel to the axial direction of the fixing belt 21 are fixedly mounted on and supported by side plates 43 of the fixing device 20, respectively.

The thermal conductor 22 has a planar face 22F that faces the fixing nip N. Specifically, the planar face 22F of the thermal conductor 22 is disposed opposite the pressing roller 31 via the fixing belt 21 at the fixing nip N. Accordingly, the fixing nip N is substantially parallel to an image side of the recording medium P to enhance fixing property, that is, to adhere the recording medium P to the fixing belt 21 more precisely. Further, such fixing nip N provides a greater curvature, that is, a smaller radius of curvature, of the fixing belt 21 at an exit of the fixing nip N, thus facilitating separation of the recording medium P discharged from the fixing nip N from the fixing belt 21.

It is to be noted that although in this exemplary embodiment, the thermal conductor 22 has the planar shape at the fixing nip N, alternatively the thermal conductor 22 may have a concave shape at the fixing nip N. In other words, the thermal conductor 22 may have a concave face, instead of the planar face 22F, which faces the pressing roller 31 so that the concave face corresponds to a curvature of the pressing roller 31. Accordingly, the recording medium P is discharged from the fixing nip N according to the curvature of the pressing roller 31. Consequently, the recording medium P does not adhere to the fixing belt 21 after the fixing process and therefore separates from the fixing belt 21.

The heater 25 may be an infrared heater such as a halogen heater and a carbon heater. As illustrated in FIG. 4, lateral ends of the heater 25 in a longitudinal direction thereof parallel to the axial direction of the fixing belt 21 are fixedly mounted on the side plates 43 of the fixing device 20, respectively. Radiation heat generated by the heater 25, which is controlled by a power supply of the image forming apparatus 1 depicted in FIG. 1, is conducted to the thermal conductor 22. The thermal conductor 22 heats substantially the entire fixing belt 21. Accordingly, heat is conducted from the outer circumferential surface of the heated fixing belt 21 to the toner image T on the recording medium P as the recording medium P is conveyed over the fixing belt 21.

As shown in FIG. 2, the temperature sensor 40 (e.g., a thermistor) disposed opposite the outer circumferential surface of the fixing belt 21 detects the temperature of the outer circumferential surface of the fixing belt 21. The controller 15, that is, a central processing unit (CPU) provided with a random-access memory (RAM) and a read-only memory (ROM), for example, operatively connected to the temperature sensor 40 and the heater 25 controls the heater 25 based on the temperature of the fixing belt 21 detected by the temperature sensor 40 so as to adjust the temperature of the fixing belt 21 to a target temperature (e.g., a fixing temperature).

As shown in FIG. 4, the thermal conductor 22 is fixedly disposed inside the fixing belt 21 in such a manner that the thermal conductor 22 is disposed opposite the inner circumferential surface of the fixing belt 21 including a surface portion thereof provided at the fixing nip N. The thermal conductor 22 is heated with radiation heat generated by the heater 25, which in turn heats the fixing belt 21. According to this exemplary embodiment, the thermal conductor 22, made of a thermal conductive metal such as aluminum, iron, or stainless steel, is heated by the heater 25. Alternatively, the thermal conductor 22 may be made of magnetic metal and heated by an exciting coil by electromagnetic induction.

As shown in FIG. 4, the thermal conductor 22 includes a center heating portion 22C disposed at a center of the thermal conductor 22 and lateral end non-heating portions 22L disposed at both lateral ends of the thermal conductor 22 and continuous with and contiguous to the center heating portion 22C in the longitudinal direction of the thermal conductor 22. The center heating portion 22C of the thermal conductor 22 that is heated by the heater 25 substantially corresponds to a heating region H provided at a center of the fixing device 20 in the axial direction of the fixing belt 21 where the heater 25 heats the fixing belt 21 via the thermal conductor 22. In the present embodiment, the heating region H corresponds to a width of a maximum recording medium P that can be accommodated in the image forming apparatus 1. By contrast, the lateral end non-heating portions 22L of the thermal conductor 22 substantially correspond to non-heating regions NH provided at lateral ends of the fixing device 20 in the axial direction of the fixing belt 21 where the heater 25 does not heat the fixing belt 21 via the thermal conductor 22. In the heating region H, at any position along the fixing belt 21 and the thermal conductor 22 other than the fixing nip N, a gap $\delta$ is provided between the fixing belt 21 and the thermal conductor 22. In the present embodiment, the gap $\delta$ has a size greater than 0 mm and not greater than 0.2 mm, that is, $0\ \text{mm}<\delta\leq 0.2\ \text{mm}$.

A lubricant, such as silicone oil or fluorine grease, is applied at the gap $\delta$ between the fixing belt 21 and the thermal conductor 22 so as to minimize wear of the fixing belt 21 and the thermal conductor 22 due to friction generated between the thermal conductor 22 and the fixing belt 21 as the fixing belt 21 slides over the thermal conductor 22.

The gap $\delta$ provided between the fixing belt 21 and the center heating portion 22C of the thermal conductor 22 having the size described above minimizes overheating of the thermal conductor 22. This is because the thermal conductor 22 thermally expands in the heating region H, minimizing the size of the gap $\delta$ between the expanded thermal conductor 22 and the rigid fixing belt 21.

A description is now given of the shape of the thermal conductor 22 in the longitudinal direction thereof according to this exemplary embodiment.

As shown in FIG. 2 illustrating the sectional view of the fixing device 20 in the heating region H, the shape of the thermal conductor 22 at the longitudinal center thereof in cross-section substantially corresponds to the shape of the fixing belt 21 in cross-section, thus facilitating heat conduction from the center heating portion 22C of the thermal conductor 22 to the fixing belt 21 and therefore minimizing overheating of the thermal conductor 22.

By contrast, as shown in FIG. 3 illustrating the sectional view of the fixing device 20 in one of the non-heating regions NH, the thermal conductor 22 contacts the fixing belt 21 in a minimized area at a position other than the fixing nip N. Accordingly, for example, a diameter of the lateral end non-heating portion 22L of the thermal conductor 22 in the non-heating region NH shown in FIG. 3 is smaller than a diameter of the center heating portion 22C of the thermal conductor 22 in the heating region H shown in FIG. 2. It is to be noted that the temperature of the lateral end non-heating portions 22L of the thermal conductor 22 in the non-heating regions NH increases to a temperature at which the viscosity of the lubricant applied between the thermal conductor 22 and the fixing belt 21 starts decreasing due to heat conduction between the thermal conductor 22 and the fixing belt 21, thus facilitating sliding of the fixing belt 21 over the thermal conductor 22.

Referring to FIG. 2, a description is now given of the pressing roller 31.

The pressing roller 31 having a loop diameter of about 30 mm is constructed of a hollow metal core 32 and an elastic outer layer 33 disposed on the metal core 32. The elastic outer layer 33 is made of silicone rubber foam, silicone rubber, fluorocarbon rubber, or the like. Optionally, a thin release layer made of PFA, PTFE, or the like may be disposed on the elastic outer layer 33, thus constituting a surface layer of the pressing roller 31. The pressing roller 31 is pressed against the fixing belt 21 to form the desired fixing nip N therebetween.

As shown in FIG. 4, a gear 45 engaging a driving gear of a driving mechanism is mounted on the pressing roller 31. Thus, the driving mechanism drives and rotates the pressing roller 31 clockwise in FIG. 2 in the rotation direction R2. Lateral ends of the pressing roller 31 in a longitudinal direction of the pressing roller 31, that is, in an axial direction of the pressing roller 31, are rotatively supported by the side plates 43 of the fixing device 20 via bearings 42, respectively. Optionally, a heat source, such as a halogen heater, may be disposed inside the pressing roller 31.

The pressing roller 31 is provided with substantially tubular grip portions 33*a* disposed opposite the lateral end non-heating portions 22L of the thermal conductor 22 in the non-heating regions NH, respectively. The grip portions 33*a* constantly press against the fixing belt 21 while the fixing device 20 is activated regardless of whether or not the recording medium P passes between the pressing roller 31 and the fixing belt 21, thus rotating the fixing belt 21 by friction between the fixing belt 21 and the grip portions 33*a* of the pressing roller 31. A portion of the pressing roller 31 disposed opposite the center heating portion 22C of the thermal conductor 22 is coated with a resin material such as PFA, thus constituting the release layer that facilitates separation of the recording medium P from the pressing roller 31. Contrarily, no release layer is provided to the grip portions 33*a* of the pressing roller 31 because no recording medium P is conveyed over the grip portions 33*a*. In the present embodiment, the elastic outer layer 33 (e.g., rubber) may be exposed to increase friction between the fixing belt 21 and the elastic outer layer 33 of the pressing roller 31 to stabilize rotation. Thus, with the grip portions 33*a*, desired friction is generated between the fixing belt 21 and the pressing roller 31 even if the pressing roller 31 is pressed against the fixing belt 21 with only relatively small pressure at the fixing nip N.

According to this exemplary embodiment, the loop diameter of the fixing belt 21 is equivalent to that of the pressing roller 31. Alternatively, the loop diameter of the fixing belt 21 may be smaller than that of the pressing roller 31. In this case, the curvature of the fixing belt 21 is greater than that of the pressing roller 31 at the fixing nip N, that is, the radius of curvature of the fixing belt 21 is smaller than that of the pressing roller 31, to ensure good separation of a recording medium P from the fixing belt 21 upon discharge from the fixing nip N.

Referring to FIGS. 1 to 4, the following describes the operation of the fixing device 20 having the above-described structure.

When the image forming apparatus 1 is activated, power is supplied to the heater 25. Simultaneously, the pressing roller 31 starts rotating in the rotation direction R2. Accordingly, friction between the pressing roller 31 and the fixing belt 21 rotates the fixing belt 21 in the rotation direction R3. In other words, the fixing belt 21 is driven by the rotating pressing roller 31. Specifically, in the heating region H that substantially corresponds to the width of the maximum recording medium P that can be accommodated in the image forming apparatus 1, the gap δ between the center heating portion 22C of the thermal conductor 22 and the fixing belt 21 is small, facilitating efficient heat conduction from the thermal conductor 22 to the fixing belt 21. Conversely, frictional resistance increases between the thermal conductor 22 and the fixing belt 21 sliding over the thermal conductor 22.

To address this circumstance, a part of the grip portions 33*a* of the pressing roller 31 contacts the outer circumferential surface of the fixing belt 21 in the heating region H, facilitating rotation of the fixing belt 21. Contrarily, in the non-heating regions NH, the lateral end non-heating portions 22L of the thermal conductor 22 contact the fixing belt 21 in an area smaller than an area in which the center heating portion 22C of the thermal conductor 22 contacts the fixing belt 21 in the heating region H, decreasing a torque produced between the pressing roller 31 and the fixing belt 21 that rotates the fixing belt 21. Further, the grip portions 33*a* of the pressing roller 31 increase friction between the grip portions 33*a* and the fixing belt 21, which rotates the fixing belt 21.

Thereafter, a recording medium P is conveyed from the paper tray 12 toward the second transfer roller 89 so that a color toner image T is transferred from the intermediate transfer belt 78 onto the recording medium P. A guide plate guides the recording medium P bearing the unfixed toner image T in the direction Y 10 so that the recording medium P bearing the unfixed toner image T enters the fixing nip N formed between the fixing belt 21 and the pressing roller 31 pressed against the fixing belt 21. As the recording medium P is conveyed through the fixing nip N, the fixing belt 21 heated by the heater 25 via the thermal conductor 22 heats the recording medium P. Simultaneously, the thermal conductor 22 and the pressing roller 31 apply pressure to the recording medium P. Thus, the heat and the pressure fix the toner image T on the recording medium P. Thereafter, the recording medium P bearing the fixed toner image T is discharged from the fixing nip N and conveyed in a direction Y11.

The thermal conductor 22 described above has different outer diameters, that is, a smaller outer diameter of the lateral end non-heating portions 22L of the thermal conductor 22 in the non-heating regions NH of the fixing device 20 as shown in FIG. 3 and a greater outer diameter of the center heating portion 22C of the thermal conductor 22 in the heating region H of the fixing device 20 shown in FIG. 2. Alternatively, the thermal conductor 22 may have one or more grooves disposed in the non-heating regions NH of the thermal conductor 22 and extending parallel to the longitudinal direction of the thermal conductor 22 as shown in FIGS. 5A, 5B, and 6.

Figure 5A:
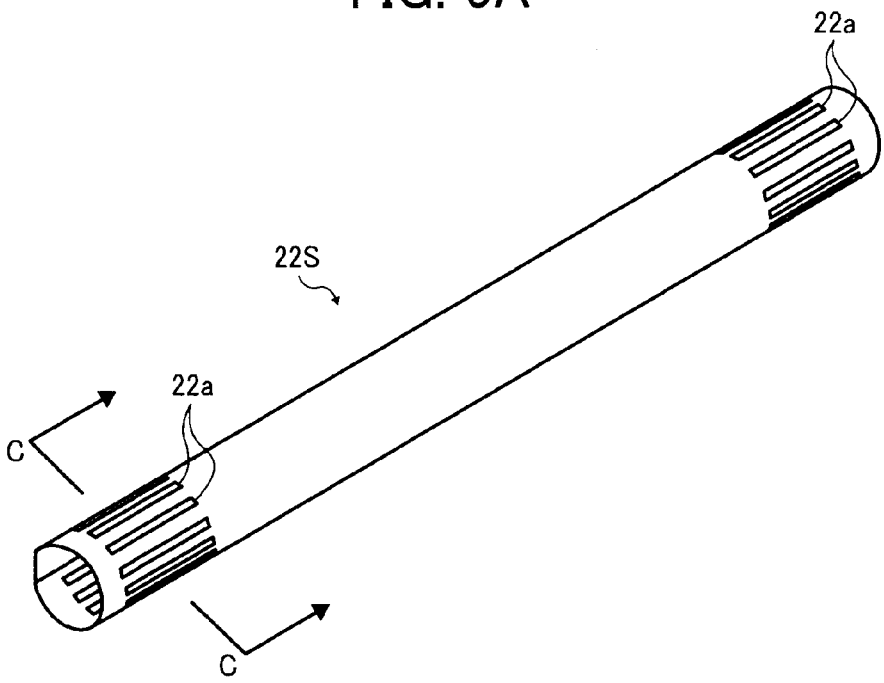
FIG. 5A is a perspective view of a thermal conductor of a fixing device according to another exemplary embodiment of the present invention.
Figure 5B:
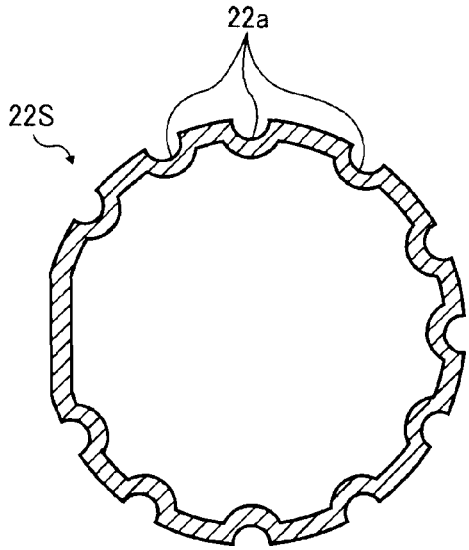
FIG. 5B is a vertical sectional view of the thermal conductor shown in FIG. 5A.
Figure 6:
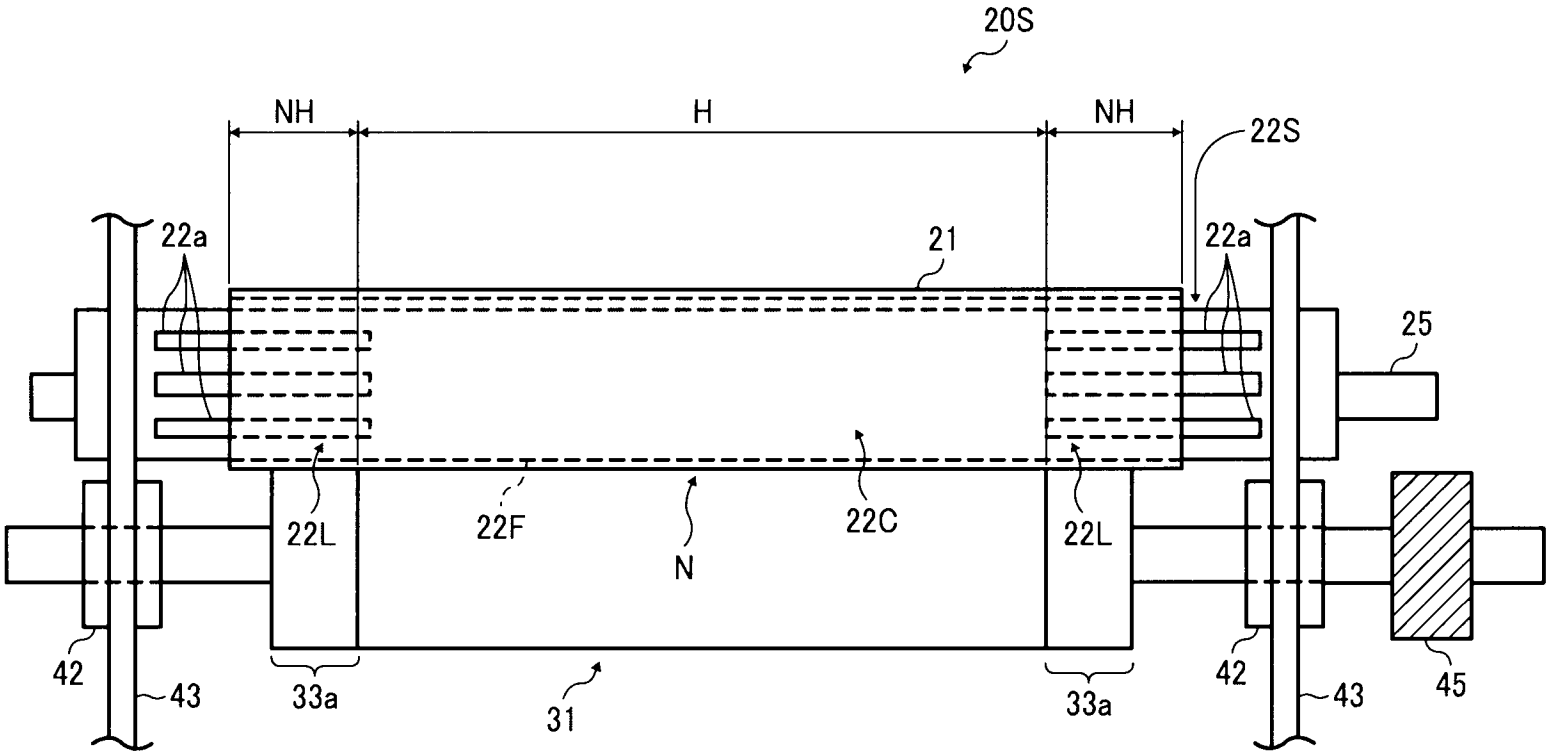
FIG. 6 is a top view of the fixing device installed with the thermal conductor shown in FIG. 5A.

Referring to FIGS. 5A, 5B, and 6, the following describes a fixing device 20S having a thermal conductor 22S provided with a plurality of grooves 22*a*.

FIG. 5A is a perspective view of the thermal conductor 22S provided with the grooves 22*a*. FIG. 5B is a sectional view of the thermal conductor 22S taken along line C-C of FIG. 5A. FIG. 6 is a top view of the fixing device 20S.

As shown in FIGS. 5A and 5B, the plurality of grooves 22*a* is disposed at lateral ends on an outer circumferential surface of the thermal conductor 22S in a longitudinal direction thereof, that is, the lateral end non-heating portions 22L of the thermal conductor 22S provided in the non-heating regions NH of the fixing device 20S. Each of the grooves 22*a* extends parallel to the longitudinal direction of the thermal conductor 22S. The grooves 22*a* decrease a contact area where the thermal conductor 22S contacts the fixing belt 21 depicted in FIG. 6, minimizing wear of the fixing belt 21 due to friction between the fixing belt 21 and the thermal conductor 22S.

Additionally, the grooves 22*a* may also serve as a lubricant reservoir that reserves a lubricant such as silicone oil or fluorine grease. In this case, heat conducted between the thermal conductor 22S and the fixing belt 21 increases the temperature of the lateral end non-heating portions 22L of the thermal conductor 22S in the non-heating regions NH of the fixing device 20S to a temperature at which the viscosity of the lubricant starts decreasing, thus facilitating sliding of the fixing belt 21 over the thermal conductor 22S.

Figure 7:
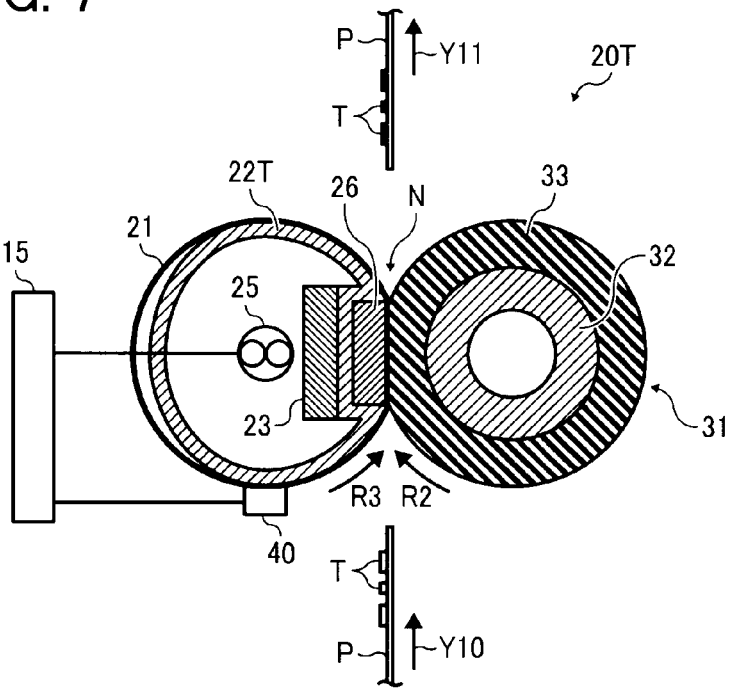
FIG. 7 is a vertical sectional view of a fixing device according to yet another exemplary embodiment of the present invention at a center of the fixing device in a longitudinal direction thereof.
Figure 8:
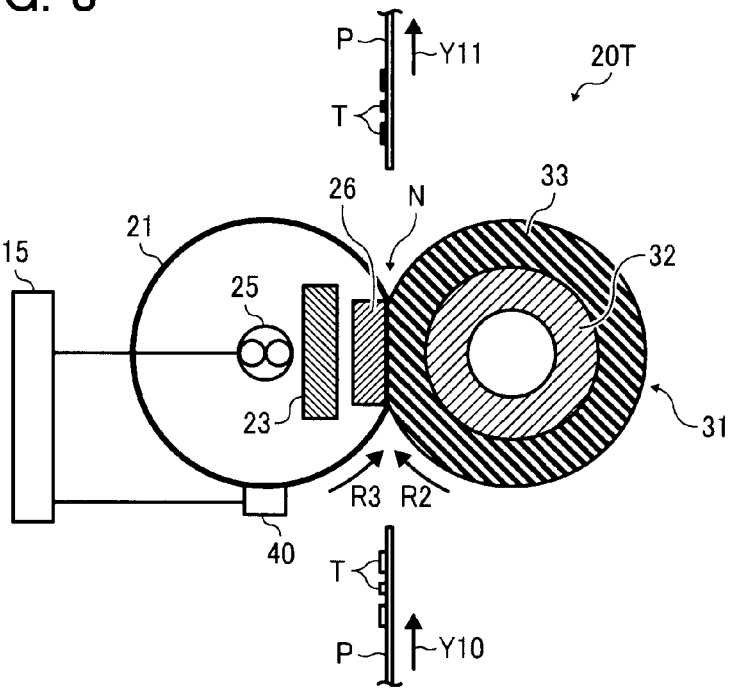
FIG. 8 is a vertical sectional view of the fixing device shown in FIG. 7 at one lateral end of the fixing device in the longitudinal direction thereof.
Figure 9:
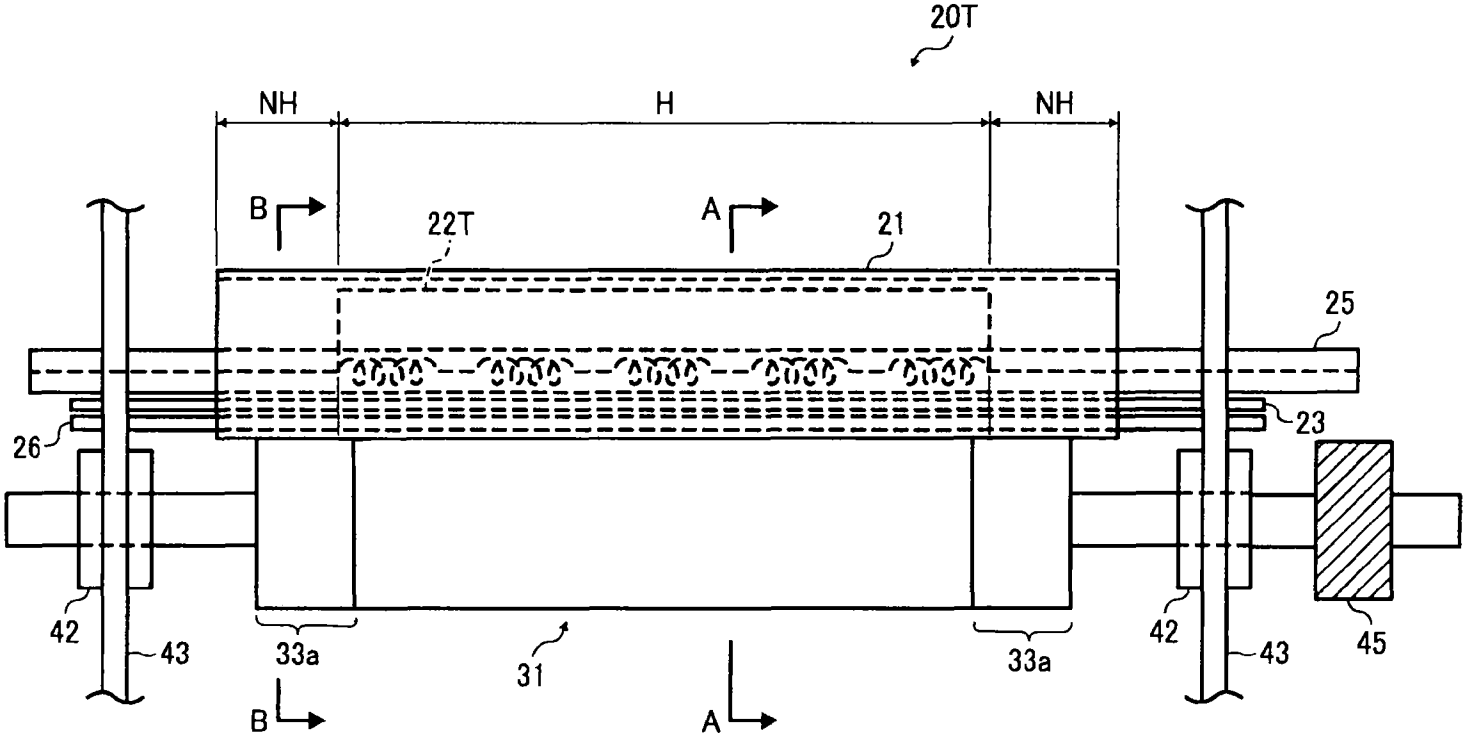
FIG. 9 is a top view of the fixing device shown in FIG. 8.

Referring to FIGS. 7 to 9, the following describes a fixing device 20T according to a second embodiment of the present invention.

According to the first embodiment described above, the pressing roller 31 is pressed against the thermal conductor 22 via the fixing belt 21 to form the fixing nip N between the pressing roller 31 and the fixing belt 21. Alternatively, the pressing roller 31 may be pressed against a nip formation pad 26 fixedly disposed inside the fixing belt 21 to form the fixing nip N between the pressing roller 31 and the fixing belt 21 as shown in FIGS. 7 and 8.

FIG. 7 is a vertical sectional view of the fixing device 20T at a center portion thereof in the longitudinal direction, that is, the axial direction, of the fixing belt 21. FIG. 8 is a vertical sectional view of the fixing device 20T at one of lateral end portions thereof in the axial direction of the fixing belt 21. It is to be noted that the fixing belt 21 heats the recording medium P at the center portion of the fixing device 20T shown in FIG. 7. Contrarily, the fixing belt 21 does not heat the recording medium P at the lateral end portions of the fixing device 20T shown in FIG. 8. The center portion and the lateral end portions of the fixing device 20T are hereinafter referred to as the heating region H and the non-heating regions NH, respectively. FIG. 9 is a top view of the fixing device 20T. Specifically, FIG. 7 is a sectional view of the fixing device 20T taken along line A-A of FIG. 9. FIG. 8 is a sectional view of the fixing device 20T taken along line B-B of FIG. 9.

Unlike the fixing devices 20 and 20S shown in FIGS. 2 and 6 according to the first embodiment, the fixing device 20T according to the second embodiment includes the nip formation pad 26 disposed opposite the inner circumferential surface of the fixing belt 21 and a thermal conductor support 23 disposed inside a substantially tubular thermal conductor 22T to support the thermal conductor 22T. The pressing roller 31 is pressed against the nip formation pad 26 via the fixing belt 21 to form the fixing nip N between the pressing roller 31 and the fixing belt 21.

As shown in FIG. 7, the nip formation pad 26 is provided separately from the thermal conductor 22T. Specifically, the nip formation pad 26 is fixedly disposed inside the loop formed by the fixing belt 21 in such a manner that the nip formation pad 26 is disposed opposite the inner circumferential surface of the fixing belt 21. The pressing roller 31 is pressed against the nip formation pad 26 via the fixing belt 21 to form the fixing nip N between the pressing roller 31 and the fixing belt 21. The thermal conductor 22T is directly disposed opposite the inner circumferential surface of the fixing belt 21 at a section of the fixing belt 21 other than a section thereof that constitutes the fixing nip N. Conversely, at the fixing nip N, the thermal conductor 22T contacts and supports the nip formation pad 26. The thermal conductor support 23 contacts an inner circumferential surface of the thermal conductor 22T to support the thermal conductor 22T at a section thereof where the thermal conductor 22T supports the nip formation pad 26.

The nip formation pad 26 is made of a material having a rigidity strong enough to resist pressure from the pressing roller 31 to prevent the nip formation pad 26 from being bent substantially, such as high rigid metal and ceramic. As shown in FIG. 9, lateral ends of the nip formation pad 26 in a longitudinal direction thereof parallel to the axial direction of the fixing belt 21 are mounted on and supported by the side plates 43 of the fixing device 20T, respectively. For example, the lateral ends of the nip formation pad 26 are detachably secured to the side plates 43 with screws, snap-fits, or the like.

Similarly, lateral ends of the thermal conductor support 23 in a longitudinal direction thereof parallel to the axial direction of the fixing belt 21 are mounted on and supported by the side plates 43 of the fixing device 20T, respectively. The thermal conductor support 23 is made of metal such as stainless steel and iron.

With the above-described configuration of the fixing device 201, the nip formation pad 26 presses against the pressing roller 31 via the fixing belt 21. Accordingly, the thermal conductor 22T does not press against the pressing roller 31. Consequently, the length of the thermal conductor 22T in a longitudinal direction thereof is equivalent to the length of the heating region H of the fixing device 201, that is, the width of the maximum recording medium P that can be accommodated in the image forming apparatus 1. In other words, the thermal conductor 22T does not extend to the non-heating regions NH of the fixing device 20T as shown in FIG. 9. The pressing roller 31 is pressed against the nip formation pad 26 via the fixing belt 21. Although the thermal conductor 22T is not in the non-heating regions NH, the nip formation pad 26 fixedly disposed in the non-heating regions NH presses against the grip portions 33*a* of the pressing roller 31 via the fixing belt 21. Thus, the grip portions 33*a* of the pressing roller 31 rotate the fixing belt 21 in accordance with rotation of the pressing roller 31 by friction between the grip portions 33*a* of the pressing roller 31 and the fixing belt 21.

Referring to FIGS. 4, 6, and 9, the following describes advantages of the fixing devices 20, 20S, and 20T. The fixing devices 20, 20S, and 20T include the fixing belt 21 serving as a fixing rotary body, the pressing roller 31 serving as a pressing rotary body, the heater 25, and the thermal conductor (e.g., the thermal conductors 22, 22S, and 22T). The thermal conductors 22, 22S, and 22T are disposed opposite the pressing roller 31 via the fixing belt 21 and disposed inside the loop formed by the fixing belt 21 to conduct heat from the heater 25 to the fixing belt 21. For example, the thermal conductors 22 and 22S include the center heating portion 22C corresponding to the heating region H of the fixing devices 20 and 20S where the heater 25 heats the thermal conductors 22 and 22S and the lateral end non-heating portions 22L corresponding to the non-heating regions NH where the heater 25 does not heat the thermal conductors 22 and 22S. The lateral end non-heating portions 22L sandwich the center heating portion 22C in the longitudinal direction of the thermal conductors 22 and 22S orthogonal to the conveyance direction of the recording medium P conveyed through the fixing nip N formed between the fixing belt 21 and the pressing roller 31.

In the fixing device 20 shown in FIG. 4, the gap between the outer circumferential surface of the thermal conductor 22 and the inner circumferential surface of the fixing belt 21 varies between the heating region H and the non-heating regions NH of the fixing device 20. In the fixing devices 20S and 20T shown in FIGS. 6 and 9, the contact area in which the outer circumferential surface of the thermal conductors 22S and 22T contact the inner circumferential surface of the fixing belt 21 varies between the heating region H and the non-heating regions NH of the fixing devices 20S and 20T. For example, as shown in FIG. 4, the gap between the thermal conductor 22 and the fixing belt 21 in the heating region H is smaller than that in the non-heating regions NH. As shown in FIGS. 6 and 9, the contact area in which the thermal conductors 22S and 22T contact the fixing belt 21 in the heating region H is greater than that in the non-heating regions NH. Accordingly, the thermal conductors 22S and 22T conduct heat from the heater 25 to the fixing belt 21 in the heating region H more efficiently, minimizing overheating of the thermal conductors 22S and 22T.

Contrarily, in the non-heating regions NH, the greater gap is provided between the thermal conductor 22 and the fixing belt 21 as shown in FIG. 4; the thermal conductor 22S contacts the fixing belt 21 at the smaller contact area as shown in FIG. 6; the thermal conductor 22T does not contact the fixing belt 21 as shown in FIG. 9, thus reducing wear of the thermal conductors 22, 22S, and 22T and the fixing belt 21 due to friction therebetween. Additionally, the pressing roller 31 rotates the fixing belt 21 with a decreased torque. Consequently, the fixing devices 20, 20S, and 20T require a decreased torque. Further, it is not necessary to increase pressure applied from the pressing roller 31 to the fixing belt 21 so as to increase friction between the pressing roller 31 and the fixing belt 21. That is, the pressing roller 31 can rotate the fixing belt 21 with pressure therebetween great enough to fix the toner image T on the recording medium P at the fixing nip N, extending the product life of the pressing roller 31 and the fixing belt 21.

Moreover, the thermal conductors 22, 22S, and 22T contact the fixing belt 21 with decreased friction, facilitating rotation of the fixing belt 21 driven by the pressing roller 31 even with variation between the products used as the fixing belt 21 and the pressing roller 31. Accordingly, slippage of the fixing belt 21 is minimized, maintaining proper fixing performance.

The heating region H is provided at the center heating portion 22C of the thermal conductors 22 and 22S in the longitudinal direction thereof. On the other hand, the pressing roller 31 is provided with the grip portions 33*a* disposed at both lateral end portions of the pressing roller 31 each of which extends from a lateral edge of the pressing roller 31 to at least a part of the heating region H on the pressing roller 31 in the axial direction of the pressing roller 31, respectively. That is, each grip portion 33*a* extends from a lateral edge of the pressing roller 31 to a position inboard of a boundary between the lateral end non-heating portion 22L of the thermal conductors 22 and 22S and the center heating portion 22C of the thermal conductors 22 and 22S. The grip portions 33*a* contact the fixing belt 21 with an increased friction therebetween. Thus, the grip portions 33*a* are disposed opposite the lateral end non-heating portions 22L of the thermal conductors 22 and 22S, respectively. Accordingly, the pressing roller 31 precisely transmits a rotation force that rotates the fixing belt 21 to the fixing belt 21 in the non-heating regions NH, preventing slippage of the fixing belt 21.

The thermal conductors 22 and 22S have substantially a circular shape in cross-section orthogonal to the longitudinal direction of the thermal conductors 22 and 22S with a diameter of the lateral end non-heating portions 22L in the non-heating regions NH smaller than a diameter of the center heating portion 22C in the heating region H. Such shape of the thermal conductors 22 and 22S decreases the contact area in which the thermal conductors 22 and 22S contact the fixing belt 21, decreasing the torque required to rotate the fixing belt 21. Further, the fixing belt 21 is inserted into the fixing devices 20 and 20S readily during assembly.

As shown in FIG. 6, the outer circumferential surface of the lateral end non-heating portions 22L of the thermal conductor 22S disposed opposite the inner circumferential surface of the fixing belt 21 in the non-heating regions NH is provided with at least one groove 22*a* extending in a direction substantially parallel to the longitudinal direction of the thermal conductor 22S. The at least one groove 22*a* decreases the contact area in which the thermal conductor 22S contacts the fixing belt 21. Additionally, the groove 22*a* may reserve the lubricant. Heat conducted from the center heating portion 22C of the thermal conductor 22S decreases the viscosity of the lubricant stored in the groove 22*a*, facilitating sliding of the fixing belt 21 over the thermal conductor 22S in the non-heating regions NH and therefore decreasing the torque required to rotate the fixing belt 21.

As shown in FIG. 9, the length of the thermal conductor 22T in the longitudinal direction thereof is shorter than the length of the pressing roller 31 in the longitudinal direction thereof. Accordingly, the thermal conductor 22T does not contact the lateral ends of the fixing belt 21 in the axial direction thereof, decreasing the torque required to rotate the fixing belt 21.

As shown in FIG. 7, the thermal conductor support 23 disposed inside the substantially tubular thermal conductor 22T supports the thermal conductor 22T at a portion of the thermal conductor 22T that is disposed opposite the fixing nip N. Accordingly, unlike the thermal conductor 22 shown in FIG. 2, it is not necessary to press the thermal conductor 22T against the pressing roller 31. Therefore, in the non-heating regions NH of the fixing device 20T, the thermal conductor 22T is not necessary.

As shown in FIG. 7, the pressing roller 31 is pressed against the nip formation pad 26 disposed inside the loop formed by the fixing belt 21 via the fixing belt 21, forming the fixing nip N between the pressing roller 31 and the fixing belt 21. The nip formation pad 26 facilitates stable formation of the fixing nip N between the pressing roller 31 and the fixing belt 21.

According to the above-described exemplary embodiments, the fixing belt 21 is used as a fixing rotary body that rotates in the predetermined direction of rotation; the pressing roller 31 is used as a pressing rotary body disposed opposite the fixing rotary body to form the fixing nip N therebetween and rotating in the direction counter to the direction of rotation of the fixing rotary body. Alternatively, a fixing film or the like may be used as a fixing rotary body; a pressing belt or the like may be used as a pressing rotary body, attaining advantages equivalent to those of the fixing devices 20, 20S, and 20T according to the above-described exemplary embodiments.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a flexible endless fixing belt formed into a loop;

a pressing rotary body pressed against an outer circumferential surface of the fixing belt to form a fixing nip therebetween through which a recording medium bearing a toner image is conveyed;

a substantially tubular thermal conductor disposed opposite an inner circumferential surface of the fixing belt; and a heater disposed inside the thermal conductor to heat the fixing belt via the thermal conductor, the thermal conductor including:

a center heating portion heated by the heater and disposed at a center of the thermal conductor in a longitudinal direction thereof orthogonal to a conveyance direction of the recording medium, the center heating portion having a first diameter such that an outer tubular surface of the center heating portion of the thermal conductor conducts heat from the heater to the fixing belt; and lateral end non-heating portions disposed at lateral ends of the thermal conductor in the longitudinal direction thereof, continuous with and contiguous to the center heating portion, outer tubular surfaces of the lateral end non-heating portions having a second diameter smaller than the first diameter of the center heating portion, to minimize conduction of heat from the heater to the fixing belt via the outer tubular surfaces of the lateral end non-heating portions of the thermal conductor.

2. The fixing device according to claim 1, wherein the pressing rotary body includes a pressing roller.

3. The fixing device according to claim 1, wherein the pressing rotary body includes substantially tubular, frictional grip portions disposed at an outer circumferential surface of lateral ends of the pressing rotary body and generating increased friction between the pressing rotary body and the fixing belt, each of the grip portions being disposed opposite the lateral end non-heating portion of the thermal conductor.

4. The fixing device according to claim 3, wherein each of the grip portions extends from a lateral edge of the pressing rotary body to a position inboard of a boundary between the lateral end non-heating portion of the thermal conductor and the center heating portion of the thermal conductor.

5. The fixing device according to claim 1, further comprising:

a first gap between the outer tubular surface of the center heating portion of the thermal conductor and the fixing belt, and a second gap between the outer tubular surfaces of the lateral end non-heating portions of the thermal conductor and the fixing belt, wherein the first gap is smaller than the second gap.

6. The fixing device according to claim 5, wherein the first gap is not greater than about 0.2 mm.

7. An image forming apparatus comprising the fixing device according to claim 1.

8. The fixing device according to claim 1, wherein the second smaller diameter is provided such that a gap between the outer tubular surfaces of the thermal conductor and the fixing belt at the lateral end non-heating portions and at a circumferential portion of the fixing belt other than the nip, is greater than the gap between the outer tubular surface of the thermal conductor and the fixing belt at the center portion and at the circumferential portion of the fixing belt other than the nip.

* * * * *